US008544704B2

(12) United States Patent
Fitzpatrick et al.

(10) Patent No.: US 8,544,704 B2
(45) Date of Patent: Oct. 1, 2013

(54) THREADING DEVICE FOR A MESH STYLE EQUIPMENT VEST

(75) Inventors: Richard M. Fitzpatrick, Longmont, CO (US); Michael T. Mayberry, Denver, CO (US); Brian L. Nakayama, Lakewood, CO (US); Eric S. Nakayama, Boulder, CO (US)

(73) Assignee: Magpul Industries Corp, Erie, CO (US)

( * ) Notice: Subject to any disclaimer, the term of this patent is extended or adjusted under 35 U.S.C. 154(b) by 428 days.

(21) Appl. No.: 11/307,493

(22) Filed: Feb. 9, 2006

(65) Prior Publication Data

US 2011/0253756 A1 Oct. 20, 2011

Related U.S. Application Data

(63) Continuation-in-part of application No. 10/906,287, filed on Feb. 11, 2005, now abandoned.

(51) Int. Cl.
*D05B 85/00* (2006.01)

(52) U.S. Cl.
USPC ..... 223/102

(58) Field of Classification Search
USPC ..... 223/99, 102–105; 112/222, 224; 289/16
See application file for complete search history.

(56) References Cited

U.S. PATENT DOCUMENTS

| | | | | | |
|---|---|---|---|---|---|
| 31,960 | A | * | 4/1861 | De Forset | 242/153 |
| 215,612 | A | * | 5/1879 | Howland | 24/40 |
| 322,284 | A | * | 7/1885 | Havell | 24/40 |
| 478,827 | A | * | 7/1892 | Stott | 223/103 |
| 481,338 | A | * | 8/1892 | Weigand | 223/103 |
| 596,554 | A | * | 1/1898 | Summers | 223/104 |
| 617,970 | A | * | 1/1899 | Ruff | 47/7 |
| 619,229 | A | * | 2/1899 | Roszell | 223/102 |
| 945,984 | A | * | 1/1910 | Schomburg | 223/102 |
| 1,341,357 | A | * | 5/1920 | Careaga | 223/102 |
| 1,639,226 | A | * | 8/1927 | Haines | 24/200 |
| 1,974,052 | A | * | 9/1934 | Lang | 223/103 |
| 2,120,030 | A | * | 6/1938 | Little | 223/102 |
| 2,190,792 | A | * | 2/1940 | Lippard | 223/102 |
| 2,422,269 | A | * | 6/1947 | Thompson | 223/102 |
| 2,620,104 | A | * | 12/1952 | Graham | 223/102 |
| 2,677,485 | A | * | 5/1954 | Surbeck | 223/102 |
| 2,705,098 | A | * | 3/1955 | Sipler, Jr | 223/102 |
| 2,721,014 | A | * | 10/1955 | Allen | 223/102 |
| 2,729,372 | A | * | 1/1956 | Winter | 223/102 |
| 2,758,648 | A | * | 8/1956 | Dodds | 163/5 |
| 3,229,484 | A | * | 1/1966 | Standart | 66/118 |
| 3,473,710 | A | * | 10/1969 | Lindquist | 223/102 |
| 3,525,460 | A | * | 8/1970 | Hendy | 223/102 |
| 4,942,646 | A | * | 7/1990 | Sebastian | 24/40 |
| 5,016,383 | A | * | 5/1991 | Rizzetto | 43/4 |
| 5,347,688 | A | * | 9/1994 | Ross | 24/40 |
| 5,815,843 | A | * | 10/1998 | Brillhart et al. | 2/247 |
| 5,881,738 | A | * | 3/1999 | Villani | 132/212 |

(Continued)

*Primary Examiner* — Shelley Self
*Assistant Examiner* — Andrew Sutton
(74) *Attorney, Agent, or Firm* — Geoffrey Dobbin; Dobbin IP Law P.C.

(57) ABSTRACT

The disclosed invention is a threader for use with various modular tactical vest systems. The particular modular vest systems have a weaving interface with attachable storage modules. A strap on a module is attached to the threader and the threader is woven through the support web on the vest. As the threader is pulled through the support web, the module is secured to the vest. Two embodiments for attaching the strap to the threader are disclosed.

12 Claims, 2 Drawing Sheets

(56) References Cited

U.S. PATENT DOCUMENTS 6,520,389 B1 * 2/2003 Bowman ..... 223/102
7,526,842 B2 * 5/2009 Wemmer ..... 24/578.13
2005/0015943 A1 * 1/2005 Wemmer ..... 24/580.1
2005/0178807 A1 * 8/2005 Fitzpatrick ..... 223/102
2007/0178761 A1 * 8/2007 Wemmer ..... 439/596

* cited by examiner

THREADING DEVICE FOR A MESH STYLE EQUIPMENT VEST

CROSS-REFERENCES TO RELATED APPLICATIONS

The present application is a Continuation-in-part of prior application Ser. No. 10/906,287, filed Feb. 11, 2005.

FIELD OF INVENTION

This invention relates to the field of threading devices and more specifically relates to a threading device utilized to secure storage modules to a tactical vest or other carrying system.

BACKGROUND OF THE INVENTION

There are a number of tactical vest systems in the current market. Some of these vests are modular and have a weaving interface with various storage modules attachable to the vest. The Pocket Attachment Ladder System, or PALs, consists of a regular pattern of straps that are parallel, equally spaced from one another and bar-tacked at 1.5 in. intervals to form a support web in the shape of a grid pattern of loops. With the PALs system, a strap attached to the storage module is threaded through a both a support web on the vest and on the module, then secured, usually with a snap closure, so that the module is held in place on the vest. The strap is then secured to prevent loosening of the strap. In so doing, these vests provide a modular tactical storage system wherein the modules are locatable on any part of the wearer's body and in any position the wearer desires. These vests, however, have one typical drawback, it is not easy to thread the module's strap through the web. What is needed, therefore, is a way to make the threading easier, either by redesigning the strap and/or the webbing or supplying a tool for use in the threading of the modules.

Threading devices are known in the prior art. However, none known to the inventor have a retention device adaptable for the attachment devices used with the current vests in the market and none have sufficient length or durability for threading through the mesh construction of the vests.

In this respect, the threading device according to the present invention departs substantially from the usual designs in the prior art. In doing so, this invention provides a threading device usable with current mesh style modular vests.

SUMMARY OF THE INVENTION

In view of the foregoing disadvantages inherent in the known types of threading device, this invention provides an improved threading device in particular design to be used with mesh style modular vest and other carrying systems. These systems typically comprise an interlocking weave of materials such as cloth, plastic, or metal. As such, the present invention's general purpose is to provide a new and improved threading device that will be readily adaptable to various types of modular vest attachment systems and will be of sufficient length and durability for use in the same.

The construction of the threading device is a simple design, starting with a thin strip of flexible, yet durable material, such as plastic or metal, having a bulbous end. The opposite end may have one of many retention structures. The first is a retention button, designed to directly interface with a snap-style attachment on a module's strap. The structure of the retention end should be such that the retention structure is contained within a harness in a handle of the strip, thereby reducing interference of the strap with the mesh while threading. An alternate structure is a simple ridge design within the harness. The material, being flexible, is ideally deformable and resilient enough for insertion between and through the ridge structure and for removal of the same while simultaneously maintaining capability to hold the strap.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
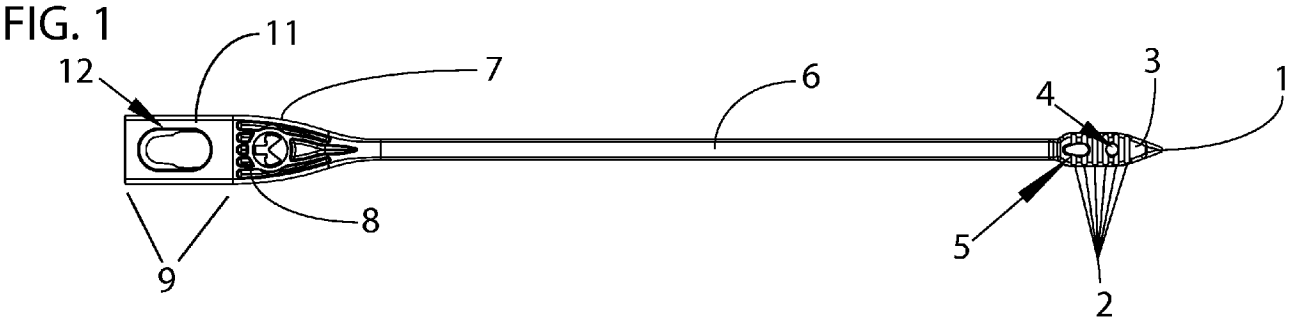
FIG. 1 is a top plan view of the threading device according to the present invention.

With reference now to the drawings, the preferred embodiment of the threading device is herein described. With reference to FIGS. 1-5, pointed tip 1 allows for the thin threading device strip 6 to be easily aligned in a PALs loop. A textured portion 2 on the bulbous head 3 to the tip 1 offers the user an ergonomic control surface in which to pull on the device. Two holes 4, 5 are placed on the bulbous head 3 to facilitate the retrofitting of para-cord, string, thin cable or wire in order to increase the effective device length or to allow for additional force to be applied during operation. The rear hole 5 is tear-drop shaped to improve the stress flow in the transition between the bulbous head 3 and the strip 6. The entire head width permits storage of the device by interfacing with the plank 10 in the harness area.

The long strip 6 portion is flexible permitting the user to bend the device in threading operations. The trunk 7, from which a harness extends, is streamlined to allow smooth passage of the device as it slides past the PALs loops. Curved ribs 8 on the trunk 7 decrease weight and material and have a curvature which maintains the outer wall profile of the trunk 7 and ensures maximum smoothness.

Figure 2:
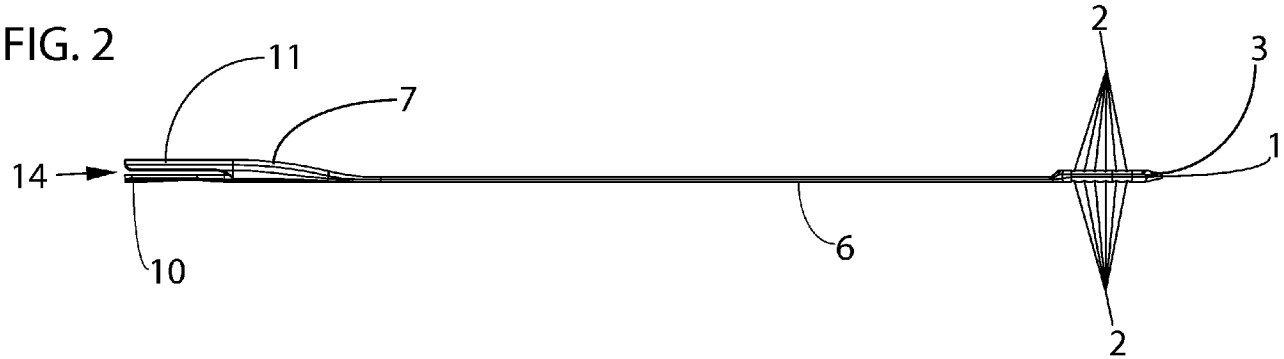
FIG. 2 is a side elevation of the threading device of FIG. 1.
Figure 3:
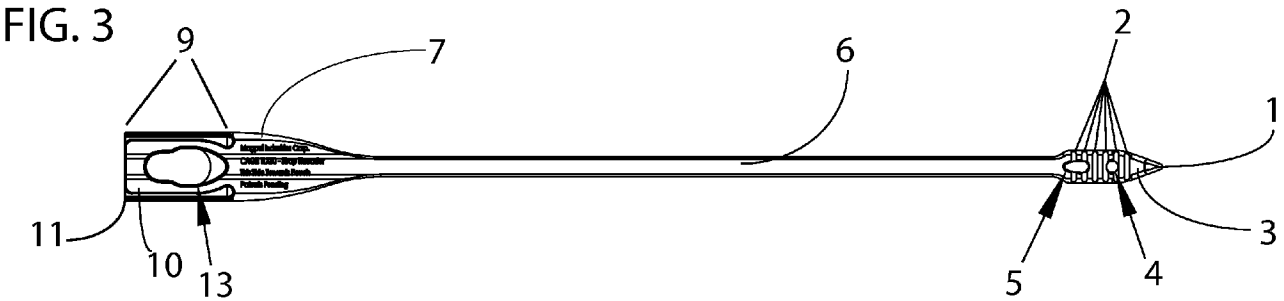
FIG. 3 is a bottom plan view of the threading device of FIG. 1.
Figure 4:
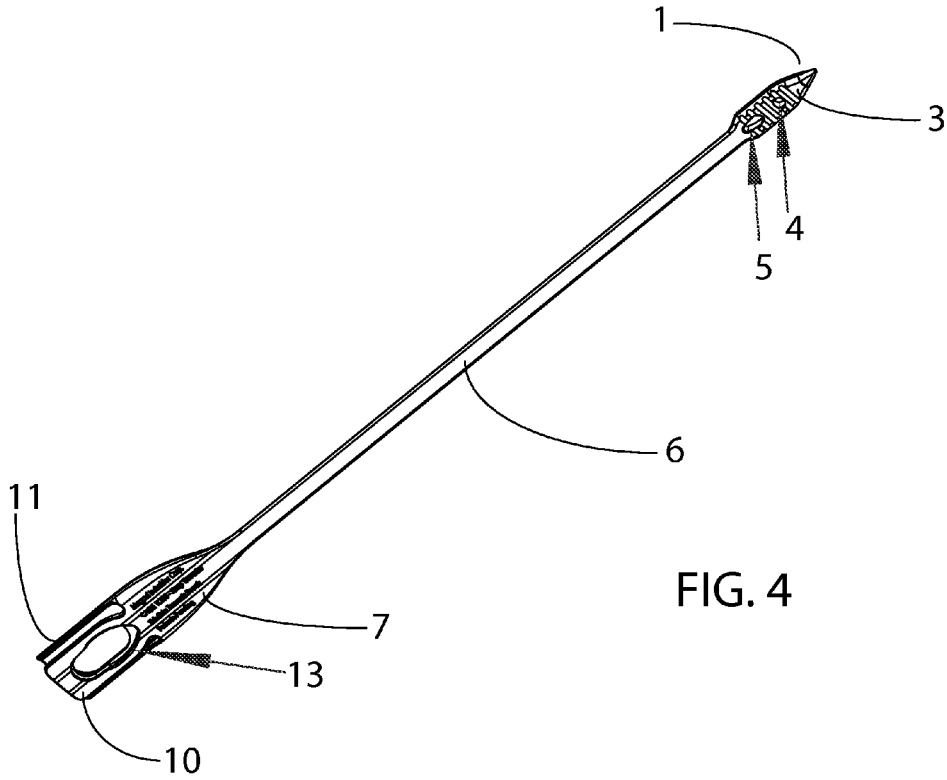
FIG. 4 is a perspective view of the threading device of FIG. 1.
Figure 5:
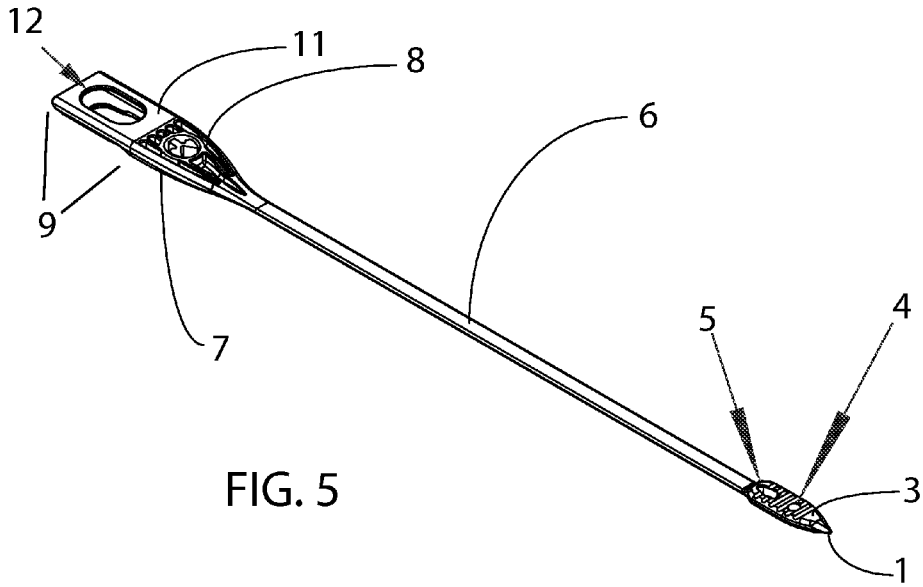
FIG. 5 is another perspective view of the threading device of FIG. 1.

The harness 9 in the rear of the trunk 7 extends therefrom in a direction opposite from the strap 6 and consists of a plank 10 and a cradle 11. It is the interface for the pouch strap. In order for the pouch strap to be inserted into the harness, the plank 10 is designed to deflect enough to allow passage of the button head between the plank 10 and cradle 11. The plank 10 is keyed in such a way as to allow the button head to drop into place after insertion and then consequently lock as the pouch strap is pulled rearward. The keyed portion 13 is formed to progressively wedge the button head into place in two directions. The front of the plank 10 is egg-shaped and has rounded edge cuts for improved stress flow in this region. The cradle 11 is U-shaped, which is best seen in FIGS. 2, 4 and 5, where the sides of the cradle 11 bend downwards towards the plank 10, such that the U-shape is facing downwards. The U-shape is designed to protect and guide the pouch strap. A channel 14 bounded by the U-shaped cradle 11 and the plank 10 restricts the pouch strap from binding during the threading process. An oval cut in the cradle 11 forms a clearance notch 12 that leaves clearance for the top of the button and prevent it from catching on PALs loops while being threaded.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A threading device for a mesh tactical vest system, the threading device comprising:

a thin strip of flexible material, having a bulbous head positioned at a fore end and a harness on a hind end opposite the bulbous head, the harness further comprising;

a trunk, extending from the thin strip;

a receiving cradle cantileverally extending from an upper half of the trunk, said cradle further comprising two cradle walls joined to form a U shape facing downwards and with an opening towards the hind end of the device and at least one clearance notch; and a deflection plank cantileverally extending from a lower half of the trunk underneath and detached from the receiving cradle such that a rearwards facing channel is formed between the deflection plank and the cradle.

2. The threading device of claim 1, the trunk further comprising a plurality of curved, reinforcing ribs that follow a curvature of the trunk.

3. The threading device of claim 2, wherein the threading device is manufactured from a material selected from the group of materials consisting of:

plastic, fiberglass, resin, paper, cardboard and metal.

4. The threading device of claim 1, the bulbous head further comprising at least one auxiliary attachment hole.

5. The threading device of claim 4, the bulbous head further comprising texturing to increase grasping friction.

6. The threading device of claim 5, the trunk further comprising a plurality of curved, reinforcing ribs.

7. The threading device of claim 6, wherein the threading device is manufactured from a material selected from the group of materials consisting of: plastic, fiberglass, resin, paper, cardboard and metal.

8. The threading device of claim 4, the trunk further comprising a plurality of curved, reinforcing ribs.

9. The threading device of claim 8, wherein the threading device is manufactured from a material selected from the group of materials consisting of: plastic, fiberglass, resin, paper, cardboard and metal.

10. The threading device of claim 1, the bulbous head further comprising texturing to increase grasping friction.

11. The threading device of claim 10, the trunk further comprising a plurality of curved, reinforcing ribs proximate the harness.

12. The threading device of claim 11, wherein the threading device is manufactured from a material selected from the group of materials consisting of: plastic, fiberglass, resin, paper, cardboard and metal.

* * * * *